United States Patent [19]

Brown

[11] Patent Number: 4,561,574

[45] Date of Patent: Dec. 31, 1985

[54] STITCHERY NEEDLE BOARD

[76] Inventor: Luba Brown, 539 W. Corona, Pueblo, Colo. 81004

[21] Appl. No.: 592,132

[22] Filed: Mar. 22, 1984

[51] Int. Cl.[4] ..... A41H 31/00

[52] U.S. Cl. ..... 223/109 R; 223/106; 223/108; 223/120; 248/474

[58] Field of Search ..... 223/109 R, 106, 107, 223/108, 109 A, 120; 248/474; 211/168, 170

[56] References Cited

U.S. PATENT DOCUMENTS

| | | | |
|---|---|---|---|
| 412,401 | 10/1889 | Mills et al. | 223/109 R |
| 732,492 | 6/1903 | Alden | 223/109 R |
| 899,696 | 9/1908 | Hochstaetter | 223/106 |
| 1,258,531 | 3/1918 | Bull | 223/109 R |
| 1,479,746 | 1/1924 | Schroeder | 223/109 R |
| 1,544,742 | 7/1925 | Grunewald | 248/474 |
| 1,555,719 | 9/1925 | Scudero | 223/109 R |
| 2,087,372 | 7/1937 | Crawford | 223/109 R |
| 2,642,211 | 6/1953 | Yingling | 223/109 R |
| 3,084,788 | 4/1963 | Ford | 223/108 X |
| 4,264,011 | 4/1981 | Dalbo et al. | 223/107 X |

FOREIGN PATENT DOCUMENTS

| | | | |
|---|---|---|---|
| 24571 | of 1907 | United Kingdom | 223/108 |

*Primary Examiner*—Werner H. Schroeder
*Assistant Examiner*—J. L. K. Olds
*Attorney, Agent, or Firm*—Henderson & Sturm

[57] ABSTRACT

A stitchery board apparatus (10) comprising a pin cushion unit (11) having a pin cushion enclosure unit (12) surrounding its periphery, a support unit (13) pivotally secured to the enclosure unit (12) and a plurality of indexes (23), (24) arranged on the apparatus such depending upon the orientation of the enclosure unit only one index will be visible in an upright position to a user of the apparatus.

1 Claim, 4 Drawing Figures

STITCHERY NEEDLE BOARD

TECHNICAL FIELD

This invention relates generally to apparatus that serve as receptacles or holders for pins and needles used in sewing.

BACKGROUND ART

Most people are aware of "pin cushion" type devises that are used to retain and support pins and needles used in sewing, in a generally upright and accessible position.

Many of these prior art devices are extremely simple in their construction and use, and comprise little more than a penetrable substrate that will accommodate a plurality of pointed sewing implement.

Other prior art devices incorporate the simple pin cushion into a decorative element such as a doll, figurine, stuffed animal or the like.

Still other prior art devices comprise very complex mechanisms and devices for retaining a plurality of pins and needles, and these devices are both cumbersome, and subject to breakage due to the number of structural elements involved.

Examples of these latter prior art devices may be seen by reference to U.S. Pat. Nos: 2,642,211; 1,479,746 and 1,258,531.

While the aforementioned prior art devices are more than adequate for their intended purpose; they are sorely inadequate for the specific purpose that the present invention has been developed for.

None of the aforementioned prior art devices are particularly well suited or adaptable for use with stitchery kits, wherein different alphabetical or numerical designations are assigned to the different colored thread or yarn used on the stitchery pattern.

Prior to the development of this invention, one needle stitchery continued to be a time consuming practice and an exercise in wasted motion; and plural needle stitchery was an equally frustrating task, because the color chart had to be constantly referred to, and the different color gradations between the thread or yarn checked prior to the next step being embarked upon.

DISCLOSURE OF THE INVENTION

The above stated problems are substantially resolved by the provisions of the instant invention. The instant invention includes a pin cushion unit, a pin cushion enclosure unit, a pivoted support unit, and an alpha-numerical indexing unit.

The pin cushion unit comprises preferably a fabric covered penetrable member that is capable of firmly supporting a plurality of stitching needles embedded therein.

The pin cushion enclosure unit comprises a generally rigid enclosure that engages and surrounds the periphery of the pin cushion unit while leaving the main portion of the pin cushion surface area exposed.

The pivoted support unit comprises one or more support members pivotally connected to the ends of the pin cushion enclosure unit, in such a manner as to support the exposed portion of the pin cushion in a variety of angular dispositions with respect to the vertical direction.

The alpha-numerical indexing unit is operatively associated with the pin cushion enclosure unit such that depending on the orientation of the enclosure unit, either an alphabetical or a numerical index will be visible in an upright position with respect to the user.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
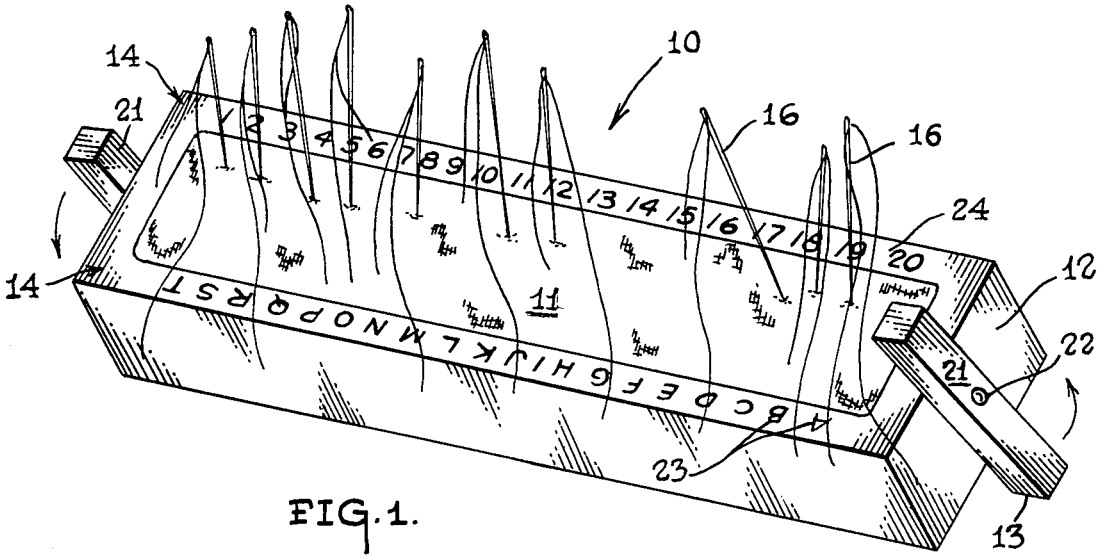
FIG. 1 is a perspective view of the apparatus.

Referring now to the drawings, and in particular to FIG. 1, the stitchery needle board apparatus may be seen as depicted generally by the numeral 10. The apparatus (10) includes generally a pin cushion unit (11), a pin cushion enclosure unit (12), a support unit (13) and an indexing unit (14). Each of these units will now be described in seriatim fashion.

The pin cushion unit (11) may be comprised of a penetrable number (15) comprised of materials such as compressed foam, rubber, rolled cloth or the like. The particular construction of the pin cushion unit is not considered to form a part of this invention; however, the manner in which the pin cushion unit is employed in conjunction with the other units is considered to be a crucial part of the invention.

As a result the penetrable member (15) may be of any well recognized construction, and may even comprise the aforementioned materials covered with a fabric (15') or a plurality of discrete elements such as beads, beans, or the like enclosed by an envelope formed by the fabric (15').

It is only necessary to practice this invention that the pin cushion element (11) be capable of supporting a plurality of penetrating elements are inserted into the pin cushion element (11).

The pin cushion enclosure unit 12 comprises a generally rigid enclosure member (17) that may be fabricated from wood, metal, plastic or the like. The enclosure member (17) is dimensioned and configured to surround at least the periphery of the pin cushion unit (11) while leaving a large portion of the surface area of the penetrable member (15) exposed.

As depicted in the drawings both the pin cushion unit (11) and the pin cushion enclosure unit (12) of the preferred embodiment have a generally rectangular configuration; however, other geometric configurations, such as circular, triangular, or the like, would be considered to be within the teachings of this invention.

In the first version of the preferred embodiment illustrated in FIG. 1, the enclosure member (17) covers the top, bottom, ends and rear faces of the penetrable members, but leaves a substantial portion of the front face (18) of the penetrable member (15) exposed.

Figure 2:
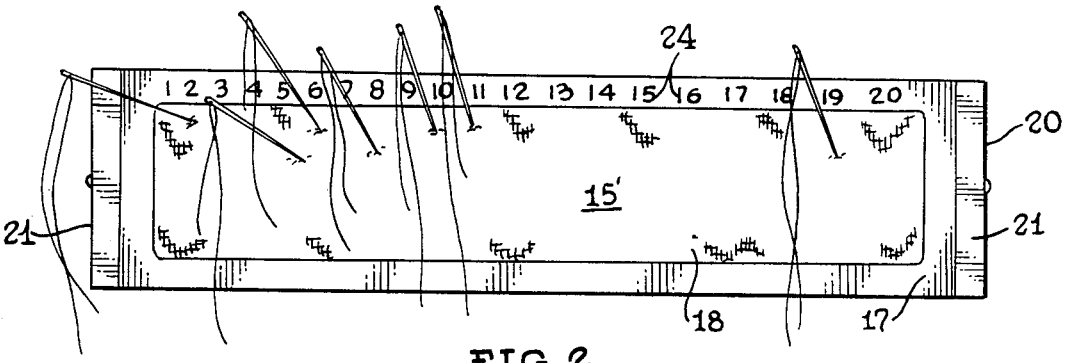
FIG. 2 is a front elevational view of one side of one form of the preferred embodiment.
Figure 3:
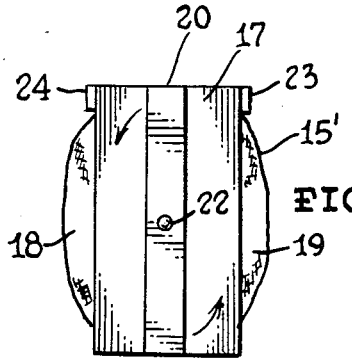
FIG. 3 is an end view of the preferred apparatus.
Figure 4:
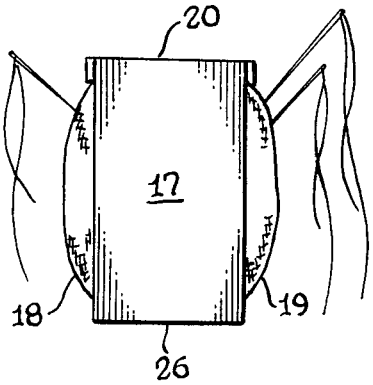
FIG. 4 is an end view of an alternate version of the preferred embodiment.

In the second version of the preferred embodiment, illustrated in FIGS. 2 thru 4, both the front face (18) and the rear face (19) of the penetrable member (15) are left exposed by the enclosure member (17). The reasons for this structural disparity between the two versions will be explained further on in the specification.

The support unit (13) comprises at least one support means (20) pivotally connected to an end of the enclosure member (17). In the preferred embodiment the support means (13) comprises a pair of support legs (21) pivotally connected on opposite ends of the enclosure member (17) with the pivot point (22) centrally disposed on each end of the enclosure member.

As shown in FIG. 1, the indexing unit (14) in the first version of the preferred embodiment comprises an alphabetical index (23) and a numerical index (24) disposed adjacent the front face of the penetrable member (15), and in an inverted relationship with respect to one another. In this version of the preferred embodiment one of the other of the indexes (23), (24) will appear in an upright position depending upon the orientation of the enclosure member (17).

The second version of the preferred embodiment is illustrated in FIGS. 2 thru 4, and in this version the indexes (23) and (24) are disposed adjacent the opposite faces (18) and (19) of the penetrable member (15). One index will appear adjacent the front face (18) and the other index will appear adjacent the back face (19). Again depending on the orientation of the enclosure member, only one of the indexes (23) or (24) will be visible in an upright position to the user.

As explained supra the support means (20) comprises a pair of support legs (21) pivotally secured to the ends of the enclosure member (17). The support legs (21) have a generally elongated rectangular configuration and their length is equal to the heighth of the ends of the enclosure member (17). This relative dimensioning allows the enclosure member to stand alone, as illustrated in FIGS. 2 and 3; or to be pivoted from the vertical orientation, and supported at an angle, as shown in FIG. 1.

In the alternate form of the preferred embodiment illustrated in FIG. 4, the support legs (21) are dispensed with, and the support means (20) comprises the elongated top (25) or bottom (26) surfaces of the enclosure member (17).

It should be appreciated at this juncture, that an apparatus built in accordance with the foregoing teachings will provide an extremely valuable device for stitchery enthusiasts; in that regardless of whether the various colored threads used in the stitchery pattern are designated by numbers or letters, the user will have a puncturable surface readily available, whereby the threaded needles bearing the different threads may be inserted and removed proximate the number or letter corresponding thereto. This device also insures that only one of the indexes will be visible in an upright position in relation to the user; and that, at least in the preferred embodiment, the apparatus may be disposed at whatever angle the user finds most comfortable, convenient or accessible from a personal standpoint.

Obviously, many modifications and variations of the present invention are possible in light of the above teachings. It is therefore to be understood that, within the scope of the appended claims, the invention may be practiced otherwise than as specifically described.

I claim:

1. A stitchery needle board apparatus adapted to retain and support a plurality of stitchery needles having a different colored thread associated with each of said plurality of needles wherein the apparatus consists of:

a pin cushion unit comprising a penetratable member;

an elongated, generally rectangular, pin cushion enclosure unit forming end members and generally open elongated side members, fabricated of generally rigid material, and surrounding at least the periphery of the pin cushion unit, so that a major portion of the surface area of the pin cushion unit is exposed thru both of the generally open elongated side members of said enclosure unit;

a pair of elongated rectangular support legs whose height is only equal to the height of the ends of the enclosure unit, and which are pivotally connected at their midpoints to the midpoints of the ends of the enclosure unit, whereby the enclosure unit may be supported by the support legs at a variety of angles with respect to the vertical; and, a plurality of indexes disposed on both generally open elongated sides of the enclosure unit adjacent the exposed portion of the pin cushion, wherein the said plurality of indexes consists of at least one alphabetical index and at least one numerical index and wherein the said plurality of indexes are arranged on each elongated side of the enclosure unit in an inverted and in an upright disposition such that only one of said plurality of indexes will be visible in a readable manner at any given time to a user of the apparatus.

* * * * *